United States Patent [19]

Breda et al.

[11] 4,120,763

[45] Oct. 17, 1978

[54] HYDROGEN TRANSFER BY METAL HYDRIDE BETWEEN AQUEOUS MEDIUM AND ORGANIC COMPOUND

[75] Inventors: Frederic Breda; Pierre Jonville, both of Geneva, Switzerland

[73] Assignee: Battelle Memorial Institute, Carouge-Geneve, Switzerland

[21] Appl. No.: 805,168

[22] Filed: Jun. 9, 1977

[30] Foreign Application Priority Data

Jun. 10, 1976 [CH] Switzerland ..... 7339/76

[51] Int. Cl.[2] ..... C25B 3/04; C25B 11/04

[52] U.S. Cl. ..... 204/73 R; 204/291; 204/76

[58] Field of Search ..... 204/291, 73 R, 72, 76, 204/290 G, 290 F

[56] References Cited

U.S. PATENT DOCUMENTS

| | | | |
|---|---|---|---|
| 3,382,106 | 5/1968 | Jung et al. | 252/182.1 |
| 3,617,462 | 11/1971 | DeWitt | 204/290 G |
| 3,879,271 | 4/1975 | Nohe et al. | 204/72 |
| 3,880,731 | 4/1975 | Rusakova et al. | 204/74 |

*Primary Examiner*—F.C. Edmundson

*Attorney, Agent, or Firm*—Karl F. Ross

[57] ABSTRACT

A process for the transfer of hydrogen to or from an organic compound comprises introducing the organic compound into an electrolysis cell containing an aqueous electrolyte and at least one working electrode consisting of a metal hydride and a counterelectrode spaced from the working electrode. An electrolysis current is passed through the cell to remove hydrogen from the metal hydride or introduce hydrogen to the metal hydride in equilibrium with the reaction with the organic compound so that evolution of gaseous hydrogen is prevented. The metal hydride consists of a first component selected from the group of titanium, zirconium, lanthanum and palladium and at least one second component selected from the group which consists of iron, nickel, cobalt, copper, chromium, manganese, vanadium, niobium and silver.

4 Claims, 3 Drawing Figures

$C_p$ %
18
16
14
12
10
8
6
4
2
0
0
1
2
3
4
5
6
7
8
9
t (h)
② - $C_2H_6$
① - $C_2H_6$
⑥ - $C_2H_6$
⑤ - $C_2H_6$
⑤ - $C_2H_4$
⑥ - $C_2H_4$
① - $C_2H_4$
② - $C_2H_4$
⑦ - $C_2H_6$
⑦ - $C_2H_4$

I $C_H$ = 83%
$C_p$ %
100
80
60
40
20
0
$CH_3CH : CHCH : CHCOOH$
$CH_3CH_2CH_2CH_2CH_2COOH$
$CH_3CH_2CH_2CH : CHCOOH$
0
10
20
30
40
50
60
$D_H$ %
$CH_3CH : CHCH_2CH_2COOH$

II $C_H$ = 50%
$C_p$ %
100
80
60
40
20
0
$CH_3CH : CHCH : CHCOOH$
$CH_3CH_2CH_2CH : CHCOOH$
$CH_3CH : CHCH_2CH_2COOH$
0
10
20
30
40
50
60
$D_H$ %
$CH_3CH_2CH_2CH_2CH_2COOH$

HYDROGEN TRANSFER BY METAL HYDRIDE BETWEEN AQUEOUS MEDIUM AND ORGANIC COMPOUND

FIELD OF THE INVENTION

The present invention relates to a process for the transfer of hydrogen continuously through the intermediary of a metal hydride between a liquid aqueous medium and an organic compound to be hydrogenated or dehydrogenated. More particularly the invention relates to a process for the hydrogenation of an organic compound or the dehydrogenation thereof in an aqueous medium.

BACKGROUND OF THE INVENTION

In synthetic organic chemistry, hydrogenation reactions are generally carried out in two types of processes:

(a) in the vapor phase by the passage of a stream of gaseous hydrogen and of the compound to be hydrogenated onto a metallic catalyst; and (b) in the liquid phase by the action of a hydrogenating agent such as hydrogen, sodium borohydride, boron hydride, magnesium hydride or lithium-aluminum hydride, or through the intermediary of homogeneous hydrogenation catalysts.

In the first case, the parameters which have an effect on the selectivity and the kinetics (reaction rate) of the vapor phase reaction are: temperature, total pressure and the partial pressure of the reactants, and the physical characteristics of the catalytic surface.

In practice, the purity of the hydrogen plays an important role since it can determine the useful life and the performance of the catalyst.

In the second phase (liquid phase hydrogenation), there are two possibilities:

(a) If the hydrogenating agent is stable in the solvent used, its use is able to preclude reactions whose free enthalpy is greater than the free enthalpy of formation of the hydrogenating agent.

(b) If the hydrogenating agent is decomposed by the solvent, the organic compound is reduced by the hydrogen freed in the reaction and the reaction becomes uncontrollable.

Furthermore, the hydrogenating agents generally used are not regeneratable but produce byproducts necessitiating operations for their removal from the system.

Thus it has been of particular interest to make use of hydrogenating agents which are regeneratable and thus do not give rise to decomposition byproducts.

There has been proposed an electrohydrogenation process which is effected with a cathode releasing hydrogen and placed in contact with the compound to be hydrogenated. However, the formation of gaseous hydrogen at the cathode readily blocks a large number of the active sites so that chemisorbtion greatly limits the overall hydrogenation kinetics.

Because of the parasitic release of hydrogen which accompanies hydrogenation, there is a significant reduction in the degree of hydrogenation and it becomes necessary to remove the excess hydrogen from the reaction medium.

In U.S. Pat. No. 3,382,106, there is described a process for producing a catalytic body which is utilizable to catalyze reactions based upon the transfer of hydrogen, especially hydrogenation reactions and dehydrogenation reactions in a galvanic cell.

This process resides in imparting a catalytic activity to a body of a metal or an alloy having a metallic crystal lattice which absorbs the hydrogen. To this end, the body is placed in contact with an alkaline solution comprising a complex reducing hydride releasing atomic hydrogen which is absorbed in the metallic crystalline lattice and is capable of forming a hydride therewith.

According to this patent, the same process can be used to reactivate the catalytic body when its catalytic activity diminishes.

Thus, while one is able, using this system, to provide a satisfactory catalyst for the reaction desired and which is reproducible to a degree, it is generally necessary to replace the catalyst after it has lost a significant part of its requisite catalytic property. The replacement is more or less frequent depending upon the nature of the catalyst and the other members of the reaction system and thus involves an interruption of the catalytic reaction at significant cost.

It has also been proposed to use a hydride of an alloy of titanium and nickel as a catalyst for hydrogenation reactions or dehydrogenation reactions, the catalyst being effective in a gaseous phase or a liquid phase. Such catalyst is able to be reused and to be regenerated chemically or electrochemically to restore the requisite catalyst properties. However, the more or less frequent replacement of the catalyst and its regeneration also is inconvenient even if only a portion of the catalyst is replaced at each time. As a result a significant quantity of the catalyst must be immobilized which can have an adverse effect on the reaction and the cost is again considerable.

OBJECTS OF THE INVENTION

It is the principal object of the present invention to provide a continuous and reproducible process for reacting an organic compound with hydrogen or, more generally, for the transfer of hydrogen to or from an organic compound for the hydrogenation or dehydrogenation thereof, eliminating as much as possible the disadvantages of the earlier systems mentioned above.

Yet another object of this invention is to provide an improved process for the hydrogenation of organic compounds in which the cost of replacing a catalyst and interruption of the process of the reaction is reduced.

Another object of the invention is to provide an improved process for dehydrogenating an organic compound without some of the aforementioned drawbacks.

SUMMARY OF THE INVENTION

These objects and others which will become apparent hereinafter are attained, in accordance with the present invention, in a process for the continuous transfer of hydrogen, with the aid of a metal hydride, between a liquid aqueous medium and an organic compound to be hydrogenated or dehydrogenated, which comprises:

(a) disposing the organic compound in an aqueous electrolyte (medium) contained within an electrolytic cell provided with a working electrode comprising a metal hydride capable of exchanging hydrogen in a reversible manner with, on the one hand, the aforementioned organic compound so as to effect a hydrogenation of dehydrogenation reaction and, on the other hand, with the aforementioned aqueous electrolyte by means of an electrochemical reaction; and (b) passing an electrolysis current between the working electrode and a counterelectrode (i.e., through the cell) in such manner that the metal hydride is regenerated electrochemically during the hydrogenation or dehydrogenation reaction so that the electrochemical reaction exchanges with the working electrode the same quantity of hydrogen that is consumed in hydrogenation of the organic compound or is derived by dehydrogenation of the organic compound, so that the exchange of hydrogen is reversible and continuous.

The electrolytic current can be controlled to maintain the condition set forth in step (b).

The metal hydrides which are used in the present invention are compounds in which the hydrogen is combined with the metal or alloy by a metallic-type bond. Such metal hydrides can be described in terms of the following properties:

(a) a high mobility for the hydrogen atoms in the interior of the metallic lattice;

(b) the availability of part of the valence electrons of the metal or alloy;

(c) a wide range of stability of the different hydrides;

(d) a hydrogen equilibrium partial pressure which is a function of temperature as determined by the relation:

$$\log pH_2 = \frac{-A}{T} + B$$

(where A and B are constants);

(e) a wide range of compositions of the hydride in which the hydrogen equilibrium partical pressure is constant and is uniquely a function of temperature;

(f) a high capacity for the storage of hydrogen per unit volume and per unit weight; and the ability of absorb the hydrogen and to desorb hydrogen in a reversible manner over a very high number of absorption and desorption cycles according to the reaction;

$$MH_x \underset{\text{absorption}}{\overset{\text{desorption}}{\rightleftharpoons}} M + \frac{x}{2} H_2 - Q$$

(where M is the metal or alloy and Q is the heat of the reaction).

The reaction of absorption-desorption is effected directly between the hydrogen and the metal or alloy according to kinetics which depend upon various parameters such as the nature of the surface of the metal or alloy, the slope of the equilibrium curve, etc.

Thus various metal hydrides which have the aforedescribed properties can be used to exchange hydrogen with an aqueous electrolyte medium by an electrochemical reversible reaction according to the invention and in accordance with the following relationships:

in aqueous alkali media:

$$MH_x + x\,OH^- \rightleftharpoons M + x\,H_2O + x\,e^-$$

in aqueous acid media:

$$MH_x \rightleftharpoons M + x\,H^+ x\,e^-.$$

The metal hydrides which are used to exchange hydrogen in a reversible manner via the electrochemical reaction with the aqueous electrolyte medium are those which are capable of carrying out the exchange without the formation of hydrogen in a gaseous state.

The metal hydrides which can be employed for the purposes of the present invention can be considered in four principal families corresponding to the metals: titanium, zirconium, lanthanum and palladium, and further containing at least one alloying element selected from the group which consists of iron, nickel, cobalt, copper, chromium, manganese, vanadium, niobium and silver.

The metal hydrides corresponding to these alloys differ sharply from one another by their capacity to store hydrogen and by their thermodynamic and electrochemical properties.

The metal hydrides thus have thermodynamic and physical-chemical properties which are of significance for the transfer of hydrogen in reactions of dehydrogenation and hydrogenation.

The hydrogenation reactions whose free enthalpy is greater than the free anthalpy of formation of the hydride do not occur. The free enthalpies of formation in the metallic hydrides for the metals or metal alloys described above can be between −2 and −30 kilocalories per mole of hydrogen. The choice, therefore, of the hydride depends a priori upon the reaction to be carried out and is able to preclude parasitic reactions.

When we refer to the reversibility of a metal hydride, we intend to consider:

on a physical level, the ability to absorb or desorb the hydrogen in equal quantities with kinetics (reaction rates) of the same order of magnitude and sufficiently high, and on the electrochemical level, its ability to absorb hydrogen by cathodic charging or to ionize hydrogen by anodic discharge in stoichiometric quantities and with overvoltages which are slight and of the same order of magnitude.

The speed of the heterogeneous reaction occurring on a solid surface depends upon various factors, including:

(a) the mass transport toward the reaction surface;

(b) the chemisorption mechanism and its energy of activation;

(c) the mechanism of the reaction in the chemisorbed phase and its energy of activation; and (d) the rates of desorption and diffusion of the products of the reaction from the surface.

The laws of diffusion thus determine essentially the rate of the reaction system at the reaction surface and the diffusion of the products from the latter.

A reaction involving the transfer of hydrogen evolves on the surface of the metal hydride, according to the invention, with kinetics of the order of unity because the hydrogen is already present in the metallic lattice and the state of the charge of the hydrogen determines the availability of the hydrogen and thus its reactivity. Furthermore, the velocity at which the hydrogen is delivered to the surface of the catalytic body is high because the speed of diffusion of hydrogen within the body is considerable.

The recharging of the surface with hydrogen is a function of the hydrogen transport to the surface and, as noted, does not constitute the reaction-limiting step because diffusion to the surface is at a high rate and the recharging of the surface of the body with hydrogen involves only the low activation of diffusion.

The chemisorption is influenced by two parameters: the number of sites available and their physical chemical characteristics.

The number of sites available for chemisorption is influenced only to a small extent by the state of charge of the hydrogen in the metal hydride.

The intermetallic bonds are reduced by the introduction of hydrogen into the metallic lattice. The catalytic activity of the chemisorption sites is thus a function of the state of the charge of the hydrogen in the metal hydride.

The velocity of the different possible reactions in the chemisorbed phase depends upon the character of the chemisorption, namely its mechanism, energy of activation and the distance between the chemisorption sites.

The desorption of the reaction products is influenced in an analogous manner to the chemisorption.

Thus in an electrode comprising a metallic hydride, the chemisorption/desorption at its surface can be influenced by the interstitial spacings and like parameters of the hydride and by the electric field acting upon the electrode.

The passage of an oxidation current or a reduction current through the metal hydride electrode is able to modify significantly the equilibrium potential of this metal hydride electrode. For example, a variation of the free enthalpy of 4.6 k cal. of the hydride corresponds to a difference of potential of 100 millivolts for a reaction mechanism giving rise to the transfer of two electrons.

An anodic polarization which results in an increase in the equilibrium potential permits suppression of the more exoenergetic reactions while a cathodic polarization permits favoring these exoenergetic reactions.

The potential applied to a metal hydride electrode, according to the invention, thus determines the type of reaction which will occur at its surface.

The passage through the electrolyte of a controllable current of appropriate level permits ready determination of the state of charge (loading) of the hydrogen of the metal hydride which, in turn, permits control of the galvanostatics of the reaction desired at the surface of the electrode more readily than is possible by potentiostatic control.

The choice of the metal hydride which is used for carrying out the process of the present invention will be determined by the thermodynamic and kinetic considerations according to whether hydrogenation or dehydrogenation is desired to be effected continuously under the operational conditions. To this end, the alloys mentioned previously having as a basis titanium, zirconium, lanthanum or palladium, have been found to be particularly effective for carrying out the invention.

For effecting the total reaction of the present invention, it is necessary to supply electrical energy to the electrolysis cell and the electrolysis current which is passed through the cell will be proportional to the velocity of transfer of hydrogen. The theoretical electrolysis voltage which is necessary corresponds to the electrolytic dissociation voltage of water (1.3 volts) less the term G/nF which corresponds to the free enthalpy of formation of the metal hydride used.

The effective voltage which one applies to the electrolysis cell will be, however, somewhat higher in practice and depends upon various operational and structural factors such as the amplitude of the electrolysis current, the composition of the aqueous electrolyte medium, the geometry of the electrodes and hence the relative positioning thereof, the structure of the cell, etc.

The theoretical yield determined by the faradic principle of the electrode used in accordance with the present invention has been found to be very close to the yield which can be obtained under appropriate conditions, i.e., is close to 100%, assuming a polarization and a level of hydrogen of the hydride electrode which is not excessive, a temperature and pressure which is convenient and other conditions which avoid any release of gaseous hydrogen at the electrode.

The process according to the present invention thus permits hydrogenation or dehydrogenation in a controllable and continuous manner using a metal hydride constituting or forming part of a working electrode and serving as a transfer agent for the hydrogen able to effect the desired reaction, thereby allowing, at the same time, control of the hydrogen level of the hydride by means of a controllable electrolysis current serving to electrochemically regenerate the electrode continuously.

The transfer of hydrogen is thus effected continuously in a controllable manner by the working electrode whose metal hydride exchanges hydrogen in a reversible fashion on the one hand with the organic compound to be hydrogenated or dehydrogenated and, on the other hand, with the aqueous electrolyte medium containing this compound.

It is thus possible to obtain a continuous transfer of hydrogen between an organic compound and an aqueous liquid medium through the intermediary of a working electrode containing a metal hydride capable of exchanging hydrogen in a reversible manner and upon which are effected at the same time two reactions, namely:

(1) a chemical reaction between the metal hydride and the organic compound in which this hydride serves as the agent effecting the transfer of hydrogen necessary for the transformation of the organic compound to a desired product, i.e., the hydrogenated or dehydrogenated product; and (2) an electrochemical reaction between the metal hydride and the aqueous medium in which the hydride is regenerated so as to maintain its level of hydrogen at a value permitting continuous realization of the hydrogen transfer under the requisite conditions.

The two reactions are carried out in an electrolysis cell during the passage of a controllable electrolysis current of appropriate magnitude between the working electrode filled with the metal hydride and a counter-electrode.

Thus if M is defined as the base alloy adapted to form a corresponding hydride, the corresponding hydride can be designated as MH and is reversibly transformed into the metal M and atomic hydrogen electrochemically. Y, for the purposes described below, can be considered to be an organic compound and YH the corresponding hydrogenated compound.

The two reactions effected at the same time can thus be represented schematically in the manner indicated below.

The hydrogenation or dehydrogenation reaction is as follows:

$$MH + Y \underset{\text{dehydrogenation}}{\overset{\text{hydrogenation}}{\rightleftharpoons}} M + YH \qquad (1)$$

The electrochemical regeneration reaction is as follows:

$$M + H_2O + e^- \rightleftarrows MH + OH^- \qquad (2)$$

The overall process corresponding to the addition of reactions 1 and 2 is given as follows:

$$Y + H_2O + e^- \underset{\text{dehydrogenation}}{\overset{\text{hydrogenation}}{\rightleftharpoons}} YH + OH^- \quad (3)$$

In the case of a hydrogenation of a molecule Y to the corresponding hydrogenated organic compound YH, the reaction (1) evolves from left to right as is the case with reaction (2) in which the metal hydride is regenerated cathodically and is thus recharged with hydrogen. In this case, the metal hydride is constituted as a cathode connected to the negative terminal of an electric current source of controllable voltage. The positive terminal is connected to an inert anode disposed in the same electrolysis cell so that an electrolysis current can be passed through the cell to carry out reaction (2).

At this inert anode, the anodic reaction is effected.

$$OH^- \rightarrow \tfrac{1}{2} H_2O + \tfrac{1}{4} O_2\nearrow + e^- \quad (4h.)$$

Combining the reactions (3) and (4), the total hydrogenation process corresponds to:

$$Y + \tfrac{1}{2} H_2O \rightarrow YH + \tfrac{1}{4} O_2\nearrow \quad (5h.)$$

In the case of the dehydrogenation of the organic compound YH to the dehydrogenated organic molecule Y, the transfer of hydrogen is obtained in accordance with the same principles by reaction (1), which, however, proceeds from right to left in the opposite direction. The polarity of the electrodes is thus reversed so that the working electrode comprising the metal hydride constitutes an anode connected to the positive terminal of the controllable current source while the inert counterelectrode is connected to the negative terminal of the source and constitutes the cathode of the electrolysis cell. At the working electrode, the anodic process is effected whose total reaction corresponds to reaction (3) effected from right to left. At the counterelectrode, however, the following cathodic reaction is effected:

$$H_2O + e^- \rightarrow OH^- + \tfrac{1}{2} H_2\nearrow \quad (4d)$$

Combining reactions (3) and (4d), the overall dehydrogenation reaction is obtained:

$$YH \rightarrow Y + \tfrac{1}{2} H_2\nearrow \quad (5d)$$

Because of the use of a working electrode which comprises an electrochemically reversible metal hydride, it is possible to carry out at the same time, the aforementioned two reactions (1) and (2) conforming to the present invention, the metal hydride constituting the hydrogen-transfer agent which is able to effect, in a reversible manner, the overall process according to the relation (3) given above.

It should be noted, however, that the reactions given above for convenience have been greatly simplified in order to illustrate the principles upon which the present invention is based. In practice, however, the metal hydride is partially charged with hydrogen according to the process of the present invention so that the hydrogen level varies only slightly between two states corresponding to nonstoichiometric compositions of the hydride. These two states can be represented as $MH_x$ and $MH_{x-z}$, for example, where $x$ is slightly different from $z$.

Thus the transfer of hydrogen which is effected according to the present invention can be schematically represented in the most general fashion in the manner indicated below:

transfer reaction:

$$MH_x + Y \underset{\text{dehydrogenation}}{\overset{\text{hydrogenation}}{\rightleftharpoons}} MH_{x-z} + YH_z \quad (1')$$

regeneration reaction:

$$MH_{x-z} + zH_2O = ze^- \rightleftarrows MH_x + zOH^- \quad (2')$$

overall process at the working electrode:

$$Y + aH_2O + ze^- \rightleftarrows YH_z + zOH^- \quad (3')$$

hydrogenation:
anodic reaction at the counterelectrode:

$$zOH^- \rightarrow (z/2)\, H_2O + (z/4)\, O_2\nearrow + ze^- \quad (4h')$$

overall hydrogenation process:

$$Y + (z/2)\, H_2O \rightarrow YH_z + (z/4)\, O_2\nearrow \quad (5h')$$

dehydrogenation:
cathodic reaction at the counterelectrode:

$$zH_2O + ze^- \rightarrow zOH^- + (z/2)\, H_2\nearrow \quad (4d')$$

overall process of dehydrogenation:

$$YH_z \rightarrow Y + (z/2)\, H_2 \quad (5d')$$

Thanks to the combination of the two reactions which are carried out at the same time in an electrolysis cell using a working electrode comprising a metal hydride according to the invention in contact with an aqueous electrolytic medium, it is possible to combine simultaneously numerous practical advantages as given below with respect to conventional hydrogenation processes:

(i) The velocity and the selectivity of the desired hydrogenation or dehydrogenation reaction can be controlled directly by selecting, on the one hand, the direction of the electric field applied to the hydride electrode and, on the other hand, the amplitude of the electrolysis current.

(ii) The process can be carried out in a continuous and controllable manner which is highly reproducible using a single reaction vessel.

(iii) The process can be carried out with optimum utilization of a relatively small quantity of the metal hydride thanks to its electrochemical regeneration in situ such that the metal hydride is maintained charged with hydrogen to an appropriate controllable level.

(iv) The yield of the process or conversion is close to 100% based upon the hydrogen transferred by the intermediary of the metal hydride electrode, the hydrogen being formed or consumed electrochemically on the same electrode because of the simultaneous regeneration of the metallic hydride.

(v) There is a significant reduction in the total cost of the process both in terms of the investment and in terms of consumable materials and energy.

The different classes of reactions which can be carried out in accordance with the present invention are:

hydrogenation of unsaturated hydrocarbons;

reduction of carbonyl compounds or carboxyl compounds;

reduction of organonitro compounds;
hydropolymerizations; and
the opening of cyclic hydrocarbons.

BRIEF DESCRIPTION OF THE DRAWING

The above and other objects, features and advantages of the present invention will become more readily apparent from the following description, reference being made to the accompanying drawing in which.

SPECIFIC DESCRIPTION AND EXAMPLES

Example I

Figure 1:
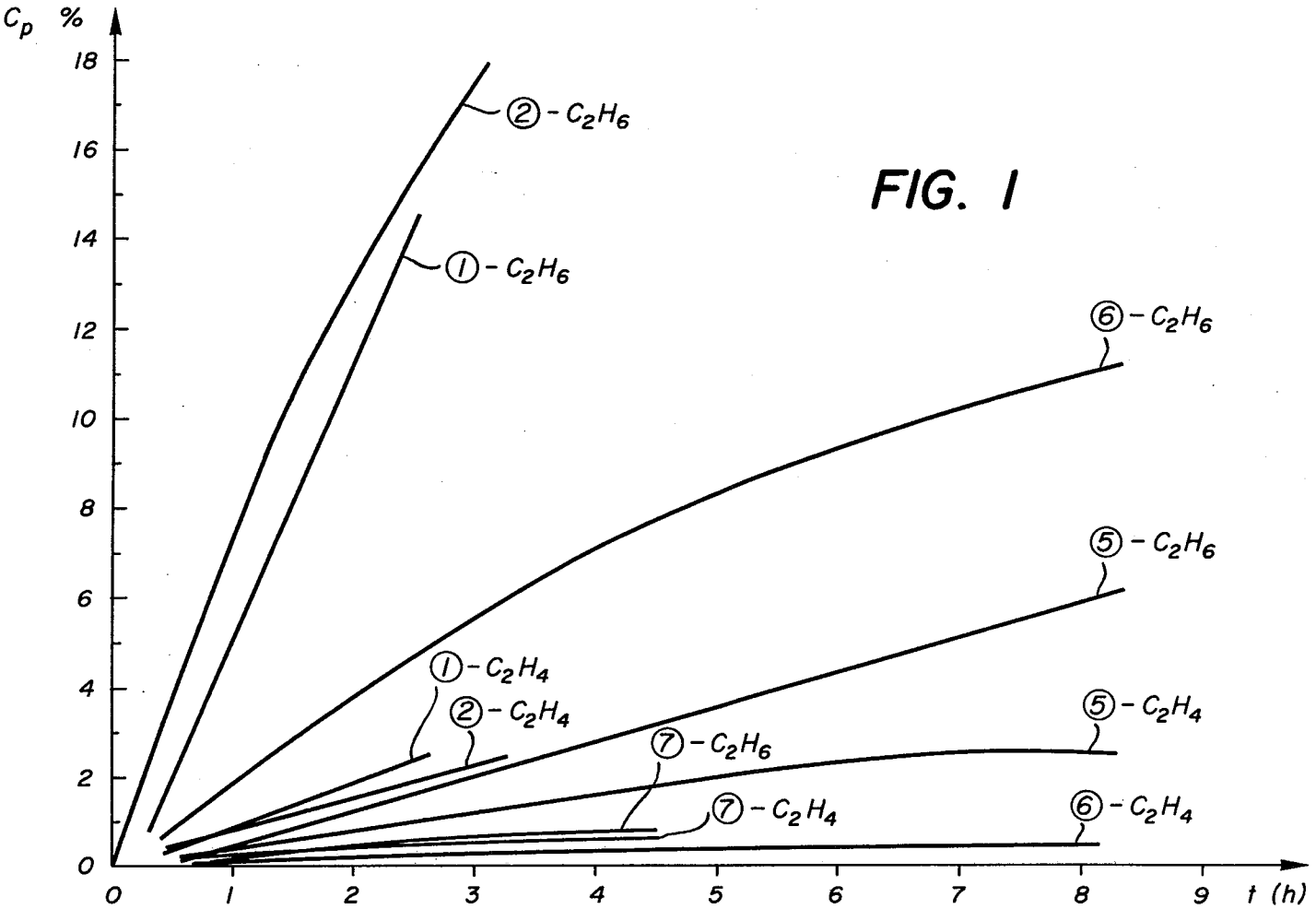
FIG. 1 is a plot of graphs illustrating the formation of products by the hydrogenation of acetylene according to Example I.

The hydrogenation of acetylene is effected continuously using a metal hydride electrode immersed in an aqueous electrolyte, namely, 6N potassium hydroxide solution.

This hydride is provided in the form of a porous electrode having a total surface area of 40 $cm^2$ and is constituted by a hydride of a titanium-nickel alloy corresponding approximately to the formula TiNi for the alloy which permits the reversible exchange of hydrogen in an amount of about 10 milligrams of hydrogen per gram of alloy.

Hydrogenation is effected in an electrolysis cell maintained thermostatically at a temperature of 50° C. and provided with a porous diaphragm (of fritted glass) which subdivides the cell into two compartments, the first being a cathodic compartment having a volume of 300 cc which is sealed and receives the electrode formed from the metal hydride. The second or anodic compartment contains an inert counterelectrode of metallic nickel. These two electrodes are disposed opposite one another and are immersed in the 6N potassium hydroxide aqueous electrolyte which partially fills these compartments of the cell in which the cathodic compartment serves for effecting the hydrogenation reaction.

Gaseous acetylene is bubbled into the electrolyte within the cathodic compartment so that the electrolyte is maintained saturated with acetylene (1 liter of acetylene gas STP per liter of electrolyte) and such that the bubbled gas purges the cathodic compartment of air. It is desirable to maintain the pressure above the liquid in the cathodic compartment slightly above atmospheric pressure with the acetylene.

The hydrogenation of the acetylene dissolved in the electrolyte evolves in the cathodic compartment and the gaseous products are analyzed by taking samples periodically (at half hour intervals) by means of a syringe sealed hermetically to the compartment in the space above the electrolyte in the cathodic compartment. The samples are analyzed by gas chromotography.

For evaluation of the process, it is convenient to define $C_H$ as the level of hydrogen in the metal hydride electrode with respect to the total quantity of hydrogen that this electrode is capable of exchanging in a reversible manner.

Tests were carried out such that the hydrogenation was evaluated with hydrogen levels of $C_H$ = 100%, 50%, and 10%, respectively, to ascertain the effect of this parameter on hydrogenation and without the passage of an electric current through the electrolytic cell.

Thereafter, two tests were carried out of hydrogenation in which a constant electric current of $i_e$ = 60mA and 6mA, respectively, by applying a voltage between 3 and 4 volts across the electrodes of the cell. This corresponds to a modification of the level of hydrogen in the metal hydride of the electrode from one test to the other of $C_H$ = 95% and $C_H$ = 50%, respectively. The products (hydrogenated organic compounds) obtained in these tests were ethane and ethylene and the graphs shown in FIG. 1 of the drawing showed the development of their respective concentrations $C_p$ as a function of time expressed as a percentage of the volume of the sample removed periodically from the cathodic compartment of the cell.

Table I, below, gives the operational parameters (hydrogen level $C_H$, and electrolysis current $i_e$) and the volumetric ratios R of ethane to ethylene which were obtained in these tests.

Comparative tests 1, 5 and 7 correspond to $i_e$ = 0 and $C_H$ = 100%, 50% and 10%, respectively.

Tests 2 and 6 correspond respectively, to $i_e$ = 60 and $i_e$ = 6mA and $C_H$ = 95% and $C_H$ = 50%, respectively.

TABLE I

| Test No. | 1 | 5 | 7 | 2 | 6 |
|---|---|---|---|---|---|
| Hydrogen level of the metal hydride electrode $C_H$ (%) | 100 | 50 | 10 | 95% | 50% |
| Electrolysis current $i_e$ (mA) | 0 | 0 | 0 | 60 | 6 |
| Ratio of ethane: ethylene = R (moles) | 6 | 1.6 | 1 | 8 | 9 |

In tests 2 and 6 effected with the passage of an electrolysis current through the cell, the faradic conversion approached 100%, i.e., practically all of the hydrogen produced by electrolysis of the water was transferred to the acetylene through the intermediary of the metallic hydride forming the negative working electrode without release of gaseous hydrogen from the latter.

As will be apparent from the curves of FIG. 1 and from Table I above:

(i) During hydrogenation in the absence of an electrolysis current (Table I, Tests 1, 5 and 7) the ratio R (ethane/ethylene) varies considerably as a function of the level $C_H$ of hydrogen of the metallic hydride while R is reduced from 6 to 1.6 as $C_H$ is reduced from 100% to 50%.

(ii) During the passage of an electrolysis current $i_e$ between 60 and 6 milliamperes, (Table I, Tests 2 and 6) the ratio R(ethane/ethylene) does not significantly vary and the hydrogen level $C_H$ of the hydride can be subjected to a more or less imilar modification between 95% and 50%.

(iii) The velocity of the hydrogenation reaction of acetylene varies as a function of the amplitude of the electrolysis current passed through the cell.

EXAMPLE II

Hydrogenation of sorbic acid $CH_3CH{:}CHCH{:}CHCOOH$ whose hydrogenation products are able to be:

2-hexenoic acid($CH_3CH_2CH_2CH{:}CHCOOH$)
3-hexenoic acid($CH_3CH_2CH{:}CHCH_2COOH$)
4-hexenoic acid($CH_3CH{:}CH_2CH_2CH_2COOH$) and
hexanoic acid($CH_3CH_2CH_2CH_2CH_2COOH$).

This hydrogenation is effected in an electrolysis cell such as has been described in Example I which is maintained thermostatically at a temperature of 50° C. and is provided with four negative electrodes of the structure described. These electrodes are positioned in parallel in the cathodic compartment opposite the positive counterelectrode.

The aqueous electrolyte is 2-normal sodium hydroxide which is disposed in the electrolysis cell whose cathodic compartment contains 500 cc of this electrolyte containing 20 grams of sorbic acid dissolved in the form of sodium sorbate.

Analysis of the hydrogenation products of sorbic acid by periodic removal of samples from the cathodic compartment, neutralization of the samples, extraction of the products with ether and analysis of the extract by gas chromotography, is carried out.

In a first test of hydrogenation the hydrogenation level $C_H$ of the working electrodes are maintained at 53% and the potential is held at a value of −880mV with respect to a mercury oxide reference electrode (Hg/HgO). Under these conditions, the terminal voltage of the cell was between 3 and 4 volts for an electrolysis current between 100mA and 60mA, permitting continuous regeneration of the metal hydride of the working electrodes. The hydrogenation was carried out for a period of 56 hours.

In a second test analogous to the first, the hydrogen level $C_H$ of the negative working electrodes was fixed at 50% by maintaining its potential at a value of −835mV with respect to the aforementioned reference electrode. The electrolysis current was between 42mA and 10mA and the duration of hydrogenation was 173 hours.

Figure 2:
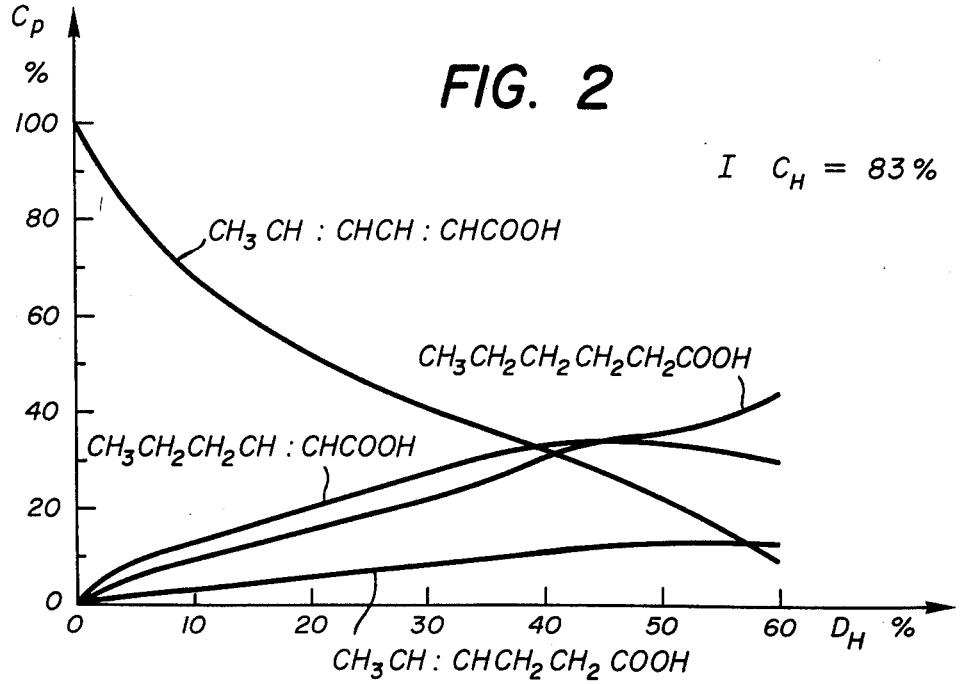
FIGS. 2 and 3 are graphs illustrating the products obtained by the hydrogenation of sorbic acid in accordance with Example II.
Figure 3:
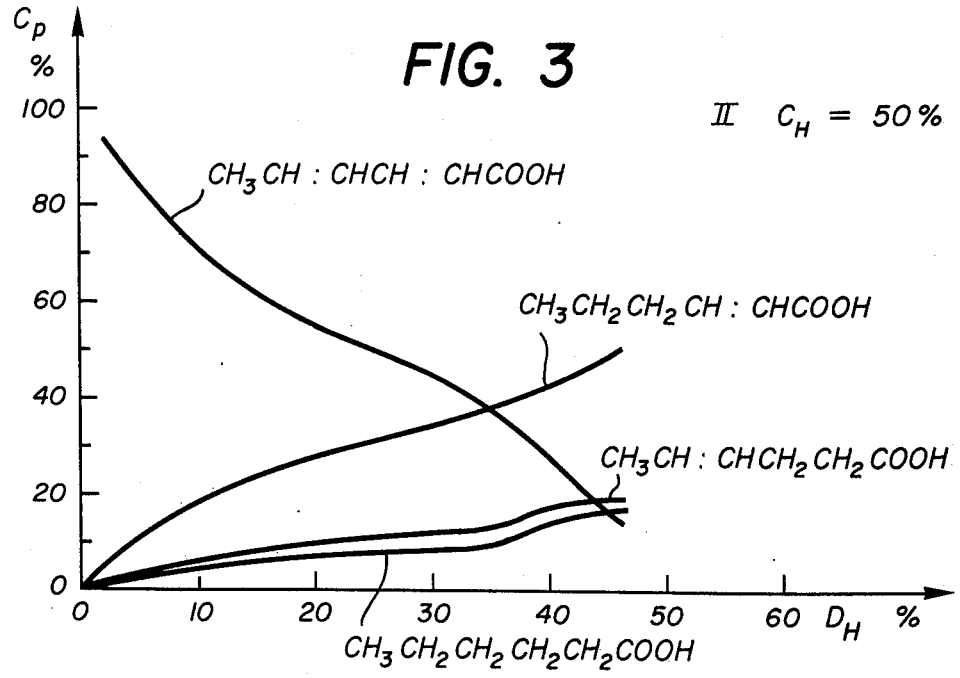

FIGS. 2 and 3 of the accompanying drawing show the measured concentrations $C_P$ of the products obtained as a function of the degree $D_h$ of hydrogenations of the sorbic acid during the first and second tests in which No. I had a $C_H = 83\%$ and No. II a $C_H = 50\%$.

Table II below gives the molar ratio R between the total hexenoic acid (i.e. the total of 2 hexenoic and 4 hexenoic acids) and the hexanoic acid ($C_6H_{12}O_2$) which is obtained at the end of the tests, such that the degree of hydrogenation is $D_H = 60\%$ in Test I and 45% in Test II, respectively.

TABLE II

| Test No. | $C_h$ | Final ratio $R_p$ of total hexenoic acid/hexanoic acid |
|---|---|---|
| I | 83% | 1 |
| II | 50% | 4.7 |

As can be seen from the results represented in FIGS. 2 and 3 and Table II:

(i) The hydrogenation effected in a cell in the manner described does not produce the 3-hexenoic acid as is obtained generally by classical hydrogenation, for example by electrochemical hydrogenation on a lead cathode or a catalytic hydrogenation on Raney nickel.

(ii) The hydrogenation of the present invention permits selective reduction of a specific conjugated double bond which is of particular interest for numerous reactions in chemical synthesis.

(iii) The ratio between the hexenoic acid (total) and the hexanoic acid can be modified by a factor of about 5 by changing the level $C_H$ of hydrogen in the metallic hydride of the working electrodes as will be apparent by comparing the results obtained when $C_H = 83\%$ and $C_H = 50\%$ (Table II).

Similar tests were carried out successfully when the titanium in the metal alloy was replaced in turn by zirconium, lanthanum and palladium. Furthermore, using each of titanium, zirconium, lanthanum and palladium, metal alloys were prepared with each of iron, nickel, cobalt, copper, chromium, manganese, vanadium, niobium, and silver with similarly effective results in hydrogenation and dehydrogenation of organic compounds in aqueous media. It was found that the atomic percent of the first alloy component (titanium, zirconium, lanthanum and palladium) could vary between 10 and 90% with the atomic percent varying between 90 and 10% (balance) of one or more of the second alloy component selected from the group which consists of iron, nickel, cobalt, copper, chromium, manganese, vanadium, niobium and silver.

In all of the Examples described, the electrolysis current and the potential across the cell were controlled so that there was no gaseous evolution of hydrogen.

I claim:

1. A process for the continuous hydrogenation of an organic compound, comprising the steps of:

(a) disposing said organic compound in an aqueous electrolyte medium contained within an electrolysis cell provided with a cathodic working electrode and a counterelectrode, said cathodic working electrode comprising a metallic hydride whose metal component consists essentially of a first component selected from the group of titanium, zirconium, lanthanum and palladium and at least one second component selected from the group which consists of iron, nickel, cobalt, copper, chromium, manganese, vanadium, niobium and silver which composition is capable of exchanging hydrogen with said organic compound and said aqueous medium in a reversible manner such that said compound reacts with hydrogen from said metallic hydride and thereby undergoes hydrogenation and that said metallic hydride is regenerated by undergoing an electrochemical reaction with said aqueous medium; and (b) passing an electrolysis current through said cell between said electrodes so that said metallic hydride is regenerated by undergoing said electrochemical reaction while said organic compound undergoes hydrogenation, said electrolysis current being such as to provide substantially continuous hydrogenation of said compound by reversible exchange of hydrogen without release of gaseous hydrogen at said working electrode.

2. The process defined in claim 1 wherein said composition consists of substantially equiatomic quantities of said first and second components.

3. The process defined in claim 2 wherein said cell is subdivided into an anode compartment and a cathode compartment by a sintered-glass separator.

4. The process defined in claim 1 wherein said metallic hydride is electrochemically regenerated at a rate corresponding substantially to that at which hydrogen from said metallic hydride reacts with said organic compound so as to maintain a substantially constant hydrogen level in said metallic hydride.

* * * * *

Dedication 4,120,763.—*Frederic Breda* and *Pierre Jonville,* Geneva, Switzerland. HYDROGEN TRANSFER BY METAL HYDRIDE BETWEEN AQUEOUS MEDIUM AND ORGANIC COMPOUND. Patent dated Oct. 17, 1978. Dedication filed Mar. 26, 1984, by the assignee, *Battelle Memorial Institute.*

Hereby dedicates to the People of the United States the entire remaining term of said patent.

[*Official Gazette May 22, 1984.*]